US006841123B1

(12) United States Patent
Nabeshima et al.

(10) Patent No.: US 6,841,123 B1
(45) Date of Patent: Jan. 11, 2005

(54) RUST-RESISTANT CALCIUM STEEL

(75) Inventors: Seiji Nabeshima, Chiba (JP); Yasuo Kishimoto, Chiba (JP); Shuji Takeuchi, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 09/680,088

(22) Filed: Oct. 5, 2000

(30) Foreign Application Priority Data

Oct. 6, 1999 (JP) ..... 11-285471

(51) Int. Cl.[7] ..... C22C 38/02
(52) U.S. Cl. ..... 420/84; 420/8; 148/320
(58) Field of Search ..... 420/84, 8; 148/320

(56) References Cited

U.S. PATENT DOCUMENTS

| | | | | |
|---|---|---|---|---|
| 5,413,754 A | * | 5/1995 | Yazawa et al. | 420/41 |
| 5,616,188 A | * | 4/1997 | Kato et al. | 148/508 |
| 6,117,389 A | * | 9/2000 | Nabeshima et al. | 164/474 |
| 6,120,578 A | * | 9/2000 | Nakato et al. | 148/625 |

FOREIGN PATENT DOCUMENTS

| | | |
|---|---|---|
| EP | 0 512 118 A1 | 11/1992 |
| EP | 0 696 645 A1 | 2/1996 |
| JP | 58-154447 | 9/1983 |
| JP | 59 035619 A | 2/1984 |
| JP | 61-276756 | 12/1986 |
| JP | 06-000559 | 1/1994 |
| JP | 06-049523 | 2/1994 |

OTHER PUBLICATIONS

J.A. Duffy et al., *Optical Basicity—IV:* Influence of Electronegtivity on the Lewis Basicity and Solvent Properties of Molten Oxyantion Salts and Glasses*, J. inorg. nucl. Chem., 1975, vol. 37, pp. 1203–1206.

D.J. Sosinsky et al., *The Composition and Temperature Dependence of the Sulfide Capacity of Metallurgical Slags*, Metallurgical Transactions B, vol. 178, Jun. 1986–331.

* cited by examiner

*Primary Examiner*—Deborah Yee
(74) *Attorney, Agent, or Firm*—Piper Rudnick LLP

(57) ABSTRACT

The composition of inclusions and the S concentration in steel are controlled in a manner such that, among the CaO-containing oxide inclusions present in a Ca-containing steel, an equilibrium S soluble amount (% S inc.) of at least 80% of the oxide inclusion particles having a particle diameter of 2 μm or more are about 0.03 wt % or less, thereby inhibiting rust formation due to the inclusions, thus solving a problem which has long been of concern in Ca-containing steels.

6 Claims, 4 Drawing Sheets

RUST-RESISTANT CALCIUM STEEL

BACKGROUND OF THE INVENTION

1. Field of the Invention

The present invention relates to a Ca-containing rust-resistant steel, containing Ca at a concentration of about 5 ppm or more. In particular, it relates to the concept of effectively reducing the formation of rust on surfaces of steel products, such rust being caused by CaO-containing oxide inclusions in the steel products, thereby solving a problem which is often of concern when Ca or Ca alloy is added to molten steel.

In accordance with this invention, the formation of large cluster-like inclusions, which would otherwise result due to the low melting point of the oxide inclusions, is prevented.

This invention further prevents nozzle clogging during the associated continuous casting process, and reduces deformability during hot rolling of sulfide inclusions.

2. Description of the Related Art

There has long been a demand for common steels such as low carbon steels and extremely low carbon steels, as well as for various stainless steels, particularly thin steel sheets, to achieve an esthetically pleasing exterior surface appearances. These steel products can usually be processed into low carbon steels by deoxidation treatments using Al, Ti, or Si to combine with oxygen in the steel. However, it is still impossible to avoid the formation of deleterious amounts of oxide inclusions in the steel products treated by Al-deoxidation or Ti-deoxidation. In fact, the oxide inclusions usually contain as their main components $Al_2O_3$ and Ti oxide, each in an amount corresponding to an oxygen content of 10 to 80 ppm.

The above oxide inclusions, mainly containing $Al_2O_3$ and Ti oxide, are likely to adhere to and thus form deposits on the internal surfaces of an immersion nozzle of the type usually employed in a continuous casting process for injecting molten steel from a tundish into a mold. As a result, the nozzle is likely to clog, making it impossible to ensure the performance of a stable casting process.

Moreover, flakes of deposited materials tend to come off the nozzle and mix into the steel product, resulting in defects in the physical properties of the steel product. Furthermore, due to the clogging of the continuous casting nozzle, the flow of the molten steel becomes deflected within the casting mold, thus resulting in the problem in that particles on the surface of the molten metal within the casting mold will be undesirably mixed into the molten metal. In addition, since $Al_2O_3$ and Ti oxide tend to form cluster-like inclusions, which usually remain on the surface of a thin steel sheet, striped defects form on the surface of the steel sheet, making it difficult to achieve a good external appearance.

In order to overcome these problems caused by $Al_2O_3$ and Ti oxide, it has been suggested to add Ca to molten steel treated by Al-deoxidation, to form an oxide composition consisting of CaO and $Al_2O_3$. Such methods are disclosed in, for example, Japanese Unexamined Patent Application Publication Nos. 61-276756, 58-154447, 6-49523).

However, it has been found that if Ca is added and is caused to react with $Al_2O_3$, some oxides having low melting points also form. These low melting oxides contain $CaO.Al_2O_3$, $12CaO.7Al_2O_3$ and $3CaO.Al_2O_3$ as their main components.

However, problems arise in MnS steels, including HIC resistant steels, and in steels required to possess a desired burring characteristic, and other steels containing MnS. Since the MnS contained in the steel tends to assert harmful influences on the desired HIC resistance and burring properties of the steel, it has also been suggested that Ca be added in order to inhibit the formation of MnS (For example, Japanese Unexamined Patent Application Publication No. 56-9317).

However, whenever Ca is added to a molten steel, the added Ca also reacts with the S contained in the steel, undesirably forming CaS, which causes the subsequent formation of rust on the surfaces of the steel products.

In an attempt to solve these complicated problems, Japanese Unexamined Patent Application Publication No. 6-559 has suggested that the Ca content of a steel product be controlled within a range of 5 ppm to less than 10 ppm, so as to prevent the formation of rust on the surface of the steel product. However, even though the Ca content is controlled to a value which is less than 10 ppm, if the composition of the oxides remaining in the steel is not specifically controlled, and if the CaO concentration in a resulting inclusion is high, the problem remains that CaS cannot be prevented from forming in the areas around the CaO-containing oxides that remain in the steel, hence forming numerous starting points at which rust will subsequently develop.

As a result, the time period before rust forms on the surface of a steel product (after the steel product has been produced) is undesirably shortened, thus increasing the amount and speed of rust formation, rendering it impossible to avoid deterioration of the external appearance of the steel products.

SUMMARY OF THE INVENTION

Accordingly, it is an object of the present invention to prevent nozzle clogging, to render Al and Ti oxides harmless, and to control the formation of sulfides, so as to produce an improved Ca-containing steel that is resistant to formation of the rust that is otherwise caused by inclusions formed on the steel surface.

As a result of extensive research, we have found that not every CaO-containing oxide inclusion causes formation of CaS in areas surrounding the oxide inclusions, nor will they all become the starting points for subsequent rust formation.

We have discovered that certain compositions of oxide inclusions actually create a situation in which the solubility of S in the oxides is decreased. We have further discovered that a solidification process conducted at a low temperature, as defined hereinafter, does not cause significant formation of CaS in areas around the oxide inclusions, whereby the oxides on the steel surface do not become effective starting points for future rust formation.

According to the present invention, we have provided an improved Ca-containing rust-resistant steel, wherein the composition of any oxide inclusions and the concentration of S contained in the steel are controlled so that among CaO-containing oxide inclusions about 80% of the oxide inclusions having particle diameters of at least 2 $\mu$m have an equilibrium S soluble amount (% S inc.) (to be further defined) which is about 0.03 wt % or less.

Furthermore, according to the present invention, it is preferred to use an equilibrium S soluble amount (% S inc.), determined in accordance with the following equation (1), including as parameters the optical basicity based upon the composition of the oxide inclusions, the casting temperature, and components forming the steel product, wherein:

$$\log(\%\ S\ inc.)=(21920-54640\Lambda)/T+43.6\Lambda-23.9-\log[aO]+\log[wt\ \%\ S] \quad (1)$$

wherein

T represents the casting temperature (K) during the continuous casting process,

[wt % S] represents the concentration by weight of S in the steel,

[aO] represents the oxygen activity of the molten steel at the casting temperature (T) during the continuous casting process, and wherein, during Al-deoxidation of the steel, $$\log aO=(-64000/T+20.57-2\log[wt\ \%\ Al]-0.086[wt\ \%\ Al]-0.102[wt\ \%\ Si]/3,$$

and wherein, during Ti-deoxidation of the steel, $$\log aO=(-60709/T+20.97-2\log[wt\ \%\ Ti]-0.084[wt\ \%\ Ti]/3,$$

and provided that, when Al and Ti are present in the steel, a smaller aO oxygen activity is provided, wherein Λ represents optical basicity of oxide inclusions according to the following equation (2):

$$\Lambda=1.0\,X(CaO)+0.605\,X(Al_2O_3)+0.601\,X(TiO_2)+0.78\,X(MgO)+0.48\,X(SiO_2)+0.55\,X(Cr_2O_3)+0.59\,X(MnO), \quad (2)$$

and wherein X (MmOn) represents the cation equivalent of the oxide present, according to the following equation (3):

$$X(MmOn)=n\times N(MmOn)/\Sigma(n\times N(MmOn)) \quad (3)$$

and wherein N(MmOn) represents the mol fraction of oxide present and n represents the valence of the oxygen contained in said oxide.

DESCRIPTION OF THE PREFERRED EMBODIMENTS

The following detailed description explains the Examples and results of the experiments performed. The Examples are not intended to limit or define the scope of the invention, which is defined in the appended claims.

A high frequency melting furnace filled with an Ar atmosphere was used to carry out the Si-deoxidation treatment (Si: 0.01 to 2.0 wt %) to treat an amount of an extremely low carbon steel having the following composition: C: 0.0015 to 0.0025 wt %; Mn: 0.15 to 0.22 wt %; P: 0.008 to 0.015 wt %; S: 0.002 to 0.020 wt %. This was followed by Al-deoxidation treatment or Ti-oxidation treatment or Al—Ti deoxidation treatment. Afterwards, Ca was added (Fe—Ca, CaSi, wherein the amount of Ca was 0.0005 to 0.0040 wt %). The composition of the oxides was altered and controlled to convert the oxides from $Al_2O_3$, Ti oxide, $Al_2O_3$—Ti oxide, or $SiO_2$-containing oxide to CaO-containing oxides.

Accordingly, the ingredients Al, Ti, Si, and Ca were reacted so as to alter the compositions of the oxides contained in the steel.

Figure 1:
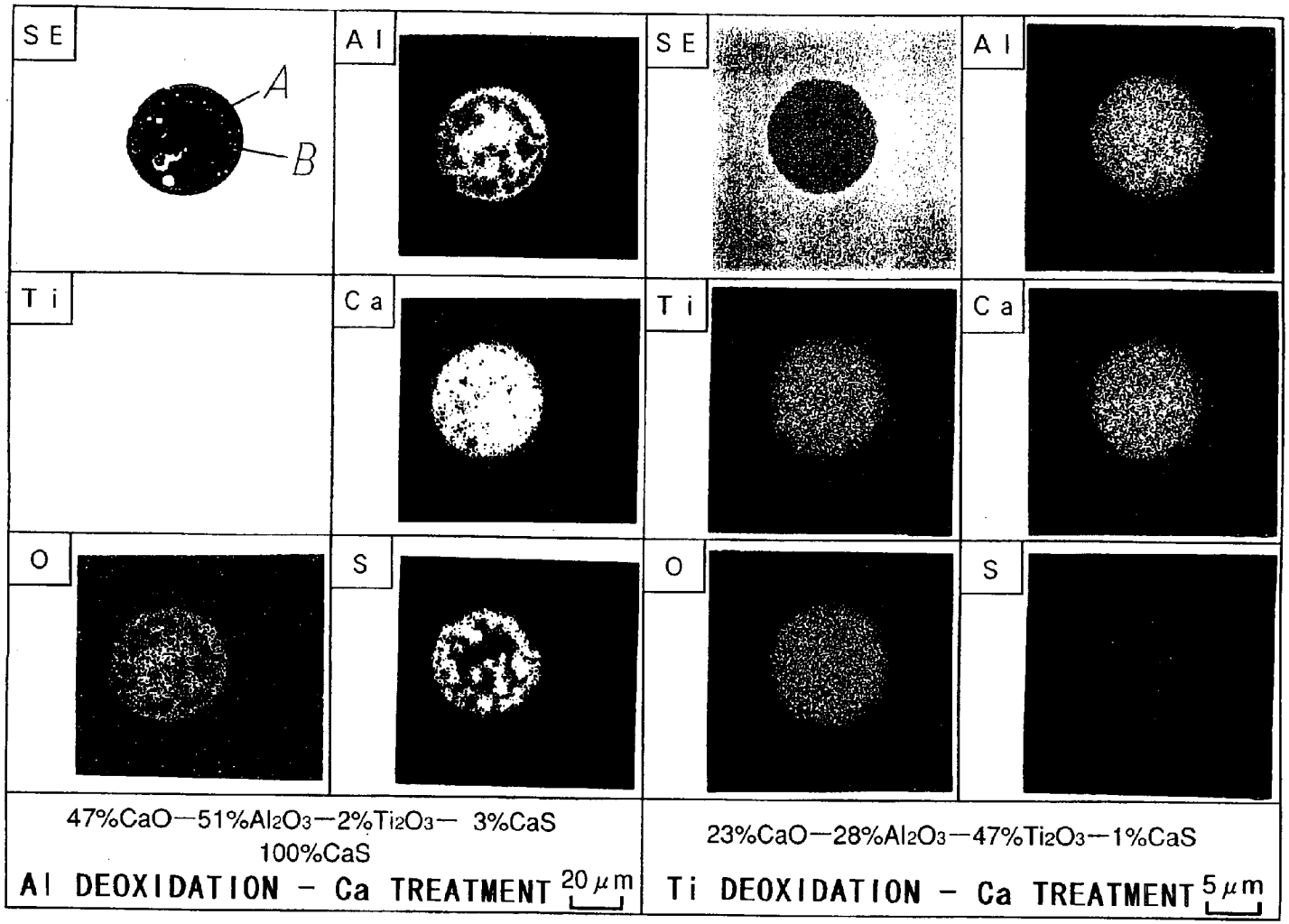
FIG. 1 shows EPMA measurement results of inclusions contained in steel blocks, representing both an example of the present invention and a comparative example.

The molten steel was then cast, whereas the organization and characteristics of the inclusions contained in steel blocks, and having a particle diameter of 2 μm or larger, were measured by the known method referred to as "EPMA". EPA means "Electron probe microanalyzer." In the EPMA method of analyzing a composition in a microscopic area, accurately, an electron beam is irradiated at an oxide inclusion, and characteristic X-rays are generated from elements in the oxide inclusion. Then the wave length and intensity of each of the X-rays are measured and analyzed with an X-ray spectroscope. Two distinct sets of analyzed results are obtained:

(i) Distribution of each of the elements by area-analysis, as shown in FIG. 1.

(ii) Quantitative value of each oxide inclusion.

Especially, Λ, the optical basicity of the oxide inclusions in formula (ii) is calculated by using the quantitative value.

Furthermore, the steel block was rolled and a test piece was cut from the steel sheet formed by rolling the steel block. The test piece was then subjected to an exposure test for 24 hours in an experimental apparatus including a chamber having a constant temperature and a constant humidity (temperature: 60° C., humidity: 95%). Moreover, the organization and characteristics of the inclusions contained in the test piece treated in the above exposure test were also measured by EPMA, thereby determining the relationship between the compositions of the oxides and the probability of rust formation.

FIG. 1 of the drawings indicates the EPMA measurement results of inclusions present in the steel blocks.

As shown in FIG. 1, by observing the left-hand two columns, the presence of a CaO—$Al_2O_3$ inclusion had the formula (47 wt % CaO-51 wt % $Al_2O_3$-2 wt % $Ti_2O_3$). It had a low melting point but a high CaO concentration. It can be seen from the formulation that considerable CaS has been precipitated inside the inclusion and in areas around the inclusion.

In contrast, by observing the right-hand two columns of FIG. 1, there is noted a CaO—$Ti_2O_3$—$Al_2O_3$ inclusion (23 wt % CaO-28 wt % $Al_2O_3$-47 wt % $Ti_2O_3$) having a low CaO concentration. In this case almost no CaS was precipitated inside the inclusion or in areas around the inclusion.

Furthermore, it has been clearly found that in a thin steel sheet made from a steel block in which CaS has been precipitated together with oxides, a large amount of rust forms. Points at which oxides exist have become rust points, with the points at which oxides exist acting as the rust starting points.

Furthermore, the compositions of many other steel blocks were investigated, and research was repeatedly conducted on the compositions of the oxides, the precipitation conditions of the CaS, and the rust formation conditions, thereby clearly demonstrating the discovery that a higher CaO concentration, i.e., a higher optical basicity of oxides, causes easier precipitation of CaS in the areas around the oxides, hence readily forming starting points which will later become points at which rust forms. In FIG. 1, 47% CaO resulted in 3% CaS, while 23% CaO resulted in only 1% CaS.

Moreover, as a result of repeated research, it has been clearly found that the resulting amount of CaS and the amount of rust formed will be further increased if the oxides have a higher sulfide capacity and if the molten steel has a reduced oxygen activity at the casting temperature of the continuous casting process.

Accordingly, as an important index, we have investigated the equilibrium S soluble amount (% S inc.) by considering both the optical basicity of the oxides and the oxygen activity during the casting process, the oxygen activity being calculated from the Al or Ti concentration.

Specifically, the equilibrium S soluble amount (% S inc.) in the steel is the soluble amount of the oxides at the casting temperature, as calculated by the method of D. J. Sosinsky, et al., in accordance with the equation (1) which follows hereinafter. The reference is D. J. Sosinsky and I. D. Sommerville, Met. Trans. B., 1986, Vol. 17B, pp. 331–337, the disclosure of which is incorporated by reference herein. As a result, it was clearly found that a larger value of the equilibrium S soluble amount (% S inc.) causes more CaS to form and deposit in areas located around the oxide particles.

However, in the equation (1) which follows, the value of the optical basicity Λ of each oxide was established by considering the coefficient of each oxide, from the compositions of the oxides, in accordance with the equation (2) which follows. The coefficients of various oxides can be obtained by the method of J. A. Duffy (J. A. Duffy and M. D. Ingram, J. Inor. Nuclear Chem., 1975, Vol. 37, pp. 1203–1206). The equations are:

$$\log(\%\ \text{S inc.})=(21920-54640\Lambda)/T+43.6\Lambda-23.9-\log[aO]+\log[\text{wt}\ \%\ S] \quad \text{(Equation 1)}$$

wherein

T represents the casting temperature (K) during the continuous casting process,

[wt % S] represents the concentration of S in the steel, and

[aO] represents the oxygen activity of the molten steel at the casting temperature (T) during the continuous casting process.

During Al-deoxidation, the log aO is expressed as follows:

$$\log aO=(-64000/T+20.57-2\log[\text{wt}\ \%\ Al]-0.066[\text{wt}\ \%\ Al]-0.102[\text{wt}\ \%\ Si]/3.$$

During Ti-deoxidation, the log aO is expressed as follows:

$$\log aO=(-60709/T+20.97-2\log[\text{wt}\ \%\ Ti]-0.084[\text{wt}\ \%\ Ti]/3.$$

However, when both Al and Ti are present, a smaller aO value should be applied, as follows:

$$\Lambda=1.0\,X(CaO)+0.605\,X(Al_2O_3)+0.601\,X(TiO_2)+0.78\,X(MgO)+0.48\,X(SiO_2)+0.55\,X(Cr_2O_3)+0.59\,X(MnO), \quad (2)$$

wherein

Λ represents the optical basicity of the oxide inclusions

X (MmOn) represents the cation equivalent of the oxide, and $$X(MmOn)=n\times N(MmOn)/\Sigma(n\times N(MmOn)) \quad (3)$$

wherein

N(MmOn) represents the mol fraction of the oxide, and n represents the valence of oxygen contained in the oxide.

However, most of the Ti oxides present in the inclusions are present in the form of $Ti_2O_3$, as shown in the above-identified results of the EPMA measurements. On the other hand, when the optical basicity Λ is to be determined in accordance with the equation (2), it is also allowable that $Ti_2O_3$ be converted to $TiO_2$ so as to calculate $X(TiO_2)$.

Figure 2:
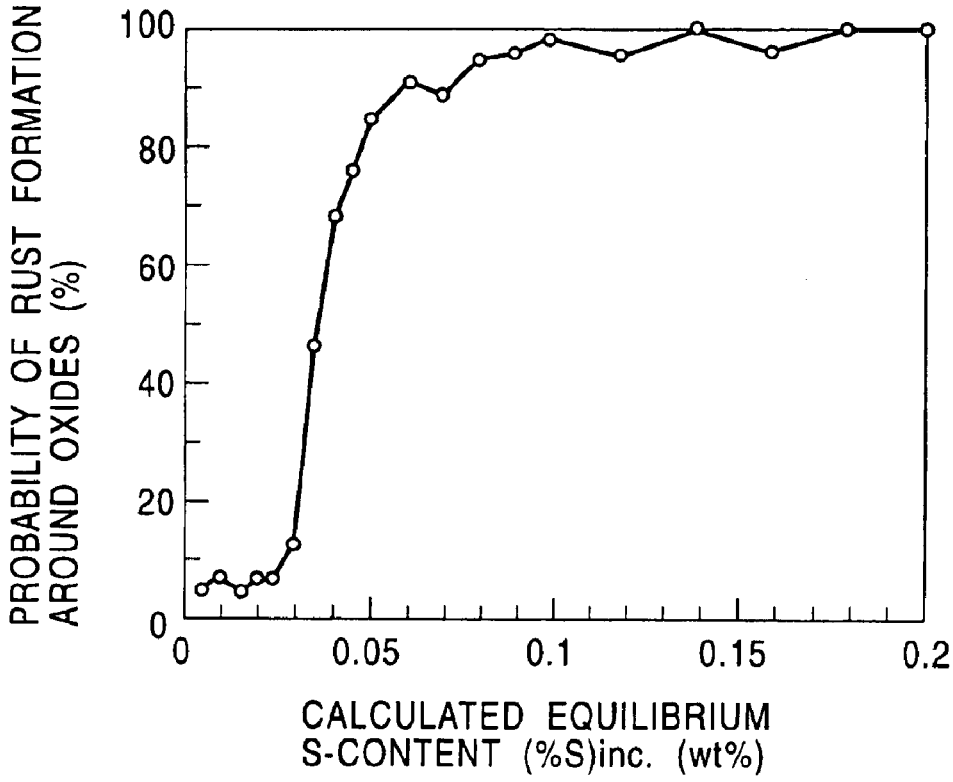
FIG. 2 is a graph showing the relationship between (a) the equilibrium S soluble amount (% S inc.) of oxides at a certain casting temperature and (b) the rust formation developed in areas around the oxides during rust formation testing. This was prepared using an experimental apparatus containing a chamber having a constant temperature of 60° C. and a constant humidity of 95%.

Next, as shown by the graph comprising FIG. 2, it is there shown that a relationship exists between (a) the equilibrium S soluble amount (% S inc.) (calculated in accordance with equations (1) and (2)) of the oxides at the casting temperature, and (b) the amount of rust formation in the areas around the oxides during the standard rust formation tests. The tests were performed using an experimental apparatus including a chamber having a constant temperature and a constant humidity (temperature: 60° C., humidity: 95%).

As shown in the graph (FIG. 2), as the equilibrium S soluble amount (% S inc.) of the oxides increases, the amount of rust formation in the areas around the oxides also increases. In particular, the amount of rust formation suddenly and rapidly increases when the equilibrium S soluble amount (% S inc.) exceeds about 0.03 wt %.

In the areas around the inclusions having an equilibrium S soluble amount (% S inc.) (before the rust formation test) which is higher than about 0.03 wt %, CaS forms at an extremely high rate. The reason for this may be explained. The CaS, formed in the areas around the inclusions, is a hydrolyzable inclusion and is subjected to a hydrolysis reaction in a manner shown in the following chemical reactions (Iron & Steel, 1982, No. 13, p. 301).

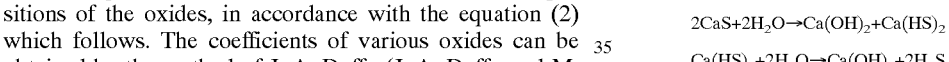

$$2CaS+2H_2O\rightarrow Ca(OH)_2+Ca(HS)_2$$

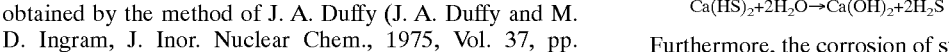

$$Ca(HS)_2+2H_2O\rightarrow Ca(OH)_2+2H_2S$$

Furthermore, the corrosion of steel has also been found to be accelerated by dissociation of the resulting $H_2S$.

Figure 3:
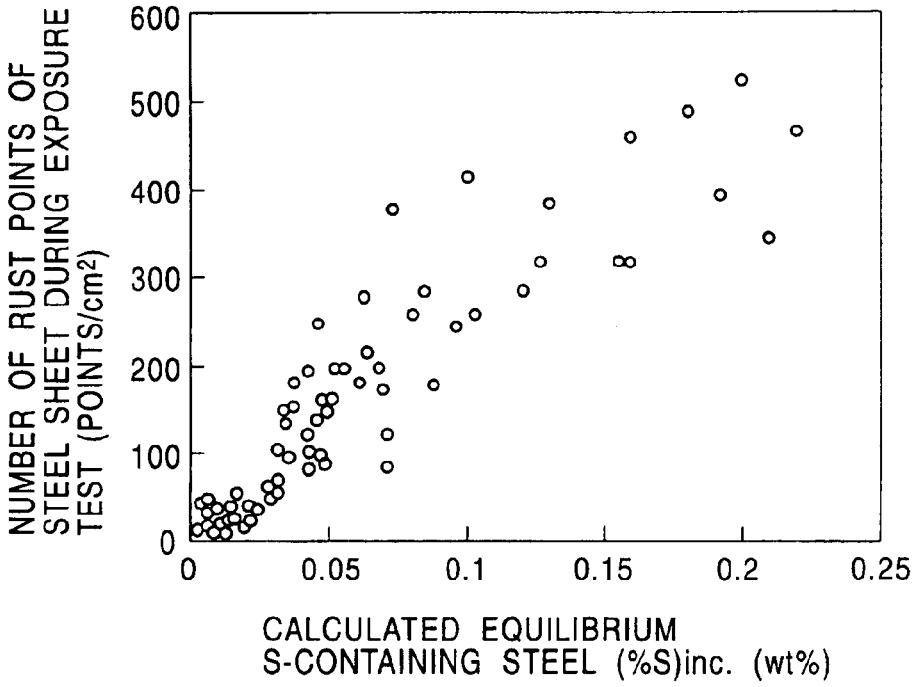
FIG. 3 is a graph indicating the relationship between (a) the equilibrium S soluble amount (% S inc.) of oxides at a specific casting temperature (the soluble amount being calculated from the average composition of oxides contained in a thin steel sheet) and (b) the number of rust spots formed on the thin steel sheet during a standard indoor exposure test to determine the extent of formation of rust. The test period was two weeks; the average temperature was 18° C.; the average humidity was 62%.

The graph FIG. 3 shows a relationship between (a) the equilibrium S soluble amount (% S inc.) of the oxides at a certain casting temperature (the soluble amount being calculated from the average oxide composition of a thin steel sheet prepared for test use) and (b) the number of rust formation points in the thin steel sheet during an indoor exposure test for determining the amount of rust formation (test period: two weeks; average temperature: 18° C.; average humidity: 62%).

As shown in the FIG. 3 graph, as the equilibrium S soluble amount (% S inc.) of the oxides increases, the number of rust points in a steel sheet also increases. In particular, the number of rust points suddenly and rapidly increases when the equilibrium S soluble amount (% S inc.) exceeds about 0.03 wt %.

Accordingly, it will be understood that the amount of rust formation in a steel product greatly depends upon the formation of CaS in the areas around the inclusions. The formation of CaS can be evaluated in accordance with the composition of the oxide inclusions, and the equilibrium S soluble amount (calculated from the temperature of the casting process and the oxygen activity of a molten steel) of the oxides at the casting temperature. Furthermore, it has been discovered from many experiments that once the equilibrium S soluble amount exceeds about 0.03 wt %, the amount of CaS formed increases, resulting in a sudden increase in the amount of rust formed.

The present invention is beneficial for use in treating all kinds of Ca-containing steels obtained by adding Ca (usually in the form of a Ca alloy) to the molten steel. In particular, the present invention is suitable for use in treating any common steel such as high carbon steel, low carbon steel, and extremely low carbon steel; stainless steel such as a ferrite stainless steel, martensite stainless steel, and austenite stainless steel; and steel containing an oxide inclusion having a CaO content of 2 $\mu$m or more.

The term "Ca-containing steel" herein means a steel whose Ca concentration is 0.0005 wt % or more.

With regard to the above-defined Ca-containing steel, an oxide that comprises CaO—$Al_2O_3$ as its main component is present in an Al-deoxidized steel. An oxide that comprises CaO—Ti oxide as its main component exists in a Ti-deoxidized steel. An oxide that comprises CaO—$Al_2O_3$—Ti oxide as its main component is present in an Al/Ti-deoxidized steel.

Furthermore, we have found that a low Al steel and a low Ti steel, each of which is an Si-deoxidized steel, also contains an oxide $SiO_2$; a high Mn steel contains an oxide MnO; a high Cr steel such as stainless steel contains an oxide $Cr_2O_3$; and an Mn-containing steel contains an Mn-oxide. However, the present invention is suitable for treating even a complex oxide containing any combination of the above oxides. Moreover, the present invention is also suitable for use in treating steel containing as much as 5 wt % of other oxides.

In addition, the present invention is particularly beneficial for use in treating an oxide inclusion having a particle diameter of 2 $\mu$m or larger, since fine particles having a particle diameter of less than 2 $\mu$m are not likely to become starting points for development of rust. Here, the particle diameter is the average diameter obtained by averaging the diameters in both the rolling direction and the width direction of the sheet.

However, not all the oxide inclusions having a particle diameter of 2 $\mu$m or larger need necessarily to be within the above described composition ranges. It is only required that at least about 80% of the above oxide particles be within the above described appropriate ranges.

The present invention is characterized in that the composition of the inclusions and the S concentration of steel are controlled so that the equilibrium S soluble amount (% S inc.) of oxides, when calculated in the above equation (1) will become about 0.03 wt % or less. On the other hand, the composition of oxides can also be controlled by using a selected deoxidant and controlling the amount of its addition.

Figure 4:
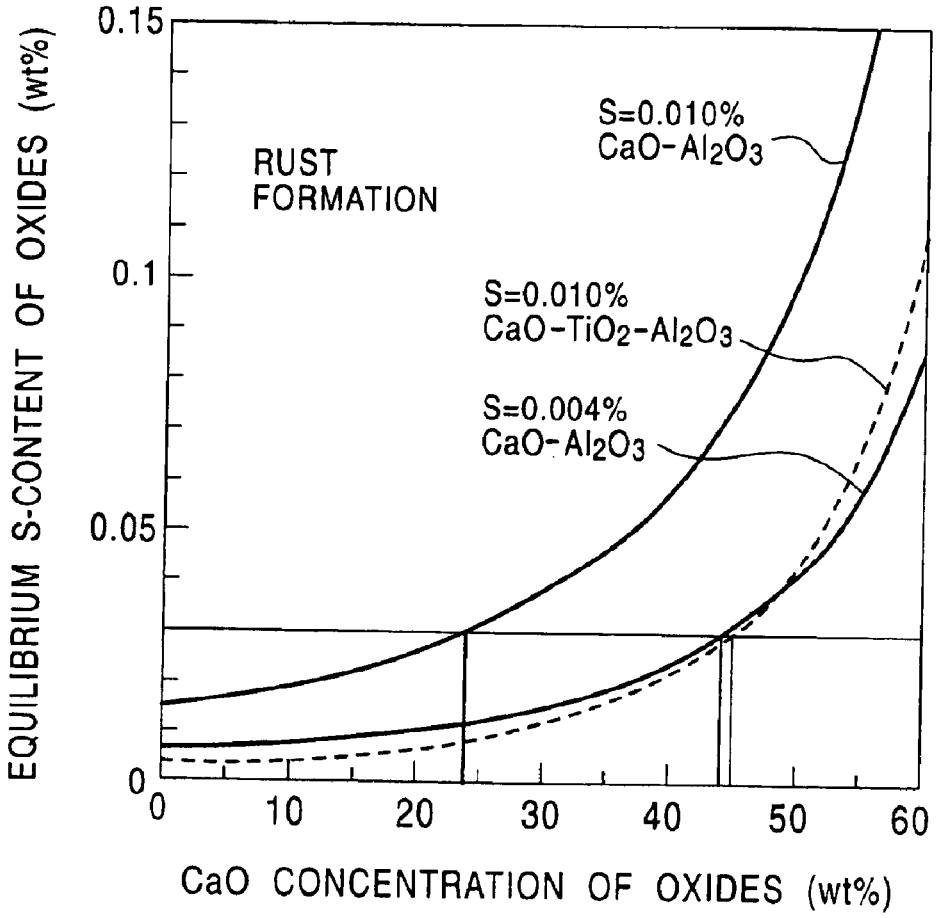
FIG. 4 is a graph showing the relationship between (a) the equilibrium S soluble amount (% S inc.) of oxides and (b) the CaO concentration of the oxides.

FIG. 4 is a graph showing the relationship between the equilibrium S soluble amount (% S inc.) of oxides and their CaO concentration, in relation to rust formation.

As shown in FIG. 4, the relationship between equilibrium S soluble amount (% S inc.) of oxides and their CaO concentration changes to some extent, depending upon the S concentration in the steel and the kind of deoxidation means that is present. However, if the CaO concentrations of the oxides are controlled so that the equilibrium S soluble amount (% S inc.) becomes about 0.03 wt % or less, it is still possible to effectively control the formation of rust on the steel surface.

On the other hand, in order to prevent the formation of large cluster-like inclusions and to prevent nozzle clogging during continuous casting, it is necessary that the oxide inclusions all have low melting points. In particular, the melting points of most oxide inclusions must be about 1650° C. or less. For this reason, in order to prevent the formation of the large cluster-like inclusions and nozzle clogging during the casting process and to inhibit rust formation on the surface of steel products, it is important to appropriately select the composition of oxides and S concentration of steel.

Furthermore, the casting temperature in the continuous casting process is typically controlled to a value about 10 to 80 degrees higher than the solidifying temperature of the steel.

EXAMPLE 1

After removal of a molten steel from a converter, 300 tons of the molten steel were subjected to decarburization in an RH vacuum degassing apparatus. The amount of remaining C was adjusted to 0.0020 wt %. Mn was adjusted to 0.20 wt %, P was adjusted to 0.015 wt %, and S was adjusted to 0.010 wt %. The temperature was adjusted to 1600° C. Then, Al was added in an amount of 0.5 kg/ton to the molten steel, thereby reducing the dissolved oxygen content of the molten steel to 150 ppm.

Next, 70 wt % Ti—Fe alloy was added in an amount of 1.2 kg/ton to the molten steel, followed by deoxidation. Subsequently, an alloy wire containing 30 wt % of Ca and 60 wt % of Si was added in an amount of 0.3 kg/ton into the molten steel, thereby adjusting the composition of the steel. After completion of the above steps, the Ti concentration was measured and determined to be 0.050 wt %. The Al concentration was measured as 0.002 wt % and the Ca concentration was measured as 15 ppm.

Next, casting was carried out in a two-strand continuous slab casting equipment. At this time, the composition of the molten steel in the tundish was such that the Ti concentration was 0.050 wt %, the Al concentration was 0.002 wt %, the Ca concentration was 15 ppm, and the S concentration was 0.010 wt %, and the casting temperature was 1560° C. As a result, substantially nothing was found to have adhered to the immersion nozzle after 5 charges of continuous casting (without blowing any Ar gas).

Subsequently, a steel slab having a thickness of 220 mm was hot rolled until its thickness became 3.5 mm. Then, the steel slab was cold rolled to a thickness of 0.8 mm, followed by an annealing treatment at a temperature of 780° C. for 45 seconds.

The final products were steel coils having a composition of Ti concentration 0.040 wt %, Al concentration 0.001 wt %, Ca concentration 15 ppm, and S concentration 0.010 wt %. The average oxide composition of 30 coils was measured by EPMA, and the measurement results were as follows: CaO 20 wt %, $Al_2O_3$ 20 wt %, and $TiO_2$ 60 wt %.

In this way, the oxygen activity of the molten steel at the casting temperature became [aO]=0.00076, the optical basicity of the oxide inclusions became $\Lambda$=0.634, and the S concentration in the steel became [wt % S]=0.010 wt %. The equilibrium S soluble amount (% S inc.) of the oxides, in accordance with the aforementioned equation (1) was 0.0084 wt %.

The coils were subjected to an indoor exposure test for determining susceptibility to rust formation (test period: two weeks; average temperature: 20° C.; average humidity: 65%). The number of rust points formed was counted, and it was found that there were 20 rust points/100 $cm^2$, which is the same level as that of an Al-deoxidized steel that does not contain Ca.

COMPARATIVE EXAMPLE 1

After removal of molten steel from a converter, 300 tons of the molten steel was subjected to a decarburization treatment in an RH vacuum degassing apparatus. C was adjusted to 0.020 wt %, Mn was adjusted to 0.20 wt %, P was adjusted to 0.015 wt %, and S was adjusted to 0.010 wt %. The temperature was adjusted to 1600° C. Then, Al was added in an amount of 1.5 kg/ton to the molten steel. Furthermore, an alloy containing 75 wt % of Ti and 25 wt % of Fe was added in an amount of 0.6 kg/ton, followed by deoxidation. Subsequently, an alloy wire containing 30 wt % of Ca and 60 wt % of Si was added in an amount of 0.4 kg/ton to the molten steel. After completion of the above treatment, the Ti concentration was 0.050 wt %, the Al concentration was 0.035 wt % and the Ca concentration was 20 ppm.

Next, a casting process was conducted in a two-strand continuous slab casting apparatus. At this time, the inclusions in the tundish were examined and were found to be spherical inclusions having a composition represented by the formula 2 wt % $Ti_2O_3$-52 wt % CaO-46 wt % $Al_2O_3$.

Further, the composition of the molten steel within the tundish was investigated and it was found that its Ti concentration was 0.050 wt %, its Al concentration was 0.030 wt %, its Ca concentration was 25 ppm, and its S concentration was 0.010 wt %. The casting temperature was 1560° C. As a result, essentially nothing was found to have adhered to the immersion nozzle after 5 charges of continuous casting (without blowing any Ar gas).

Subsequently, a steel slab was hot rolled until its thickness was 3.5 mm. Then, the steel slab was cold rolled to a thickness of 0.8 mm, followed by annealing at a temperature of 780° C. for 45 seconds.

The final products were steel coils having a Ti concentration of 0.040 wt %, an Al concentration of 0.030 wt %, a Ca concentration of 20 ppm, and an S concentration of 0.010 wt %. The average oxide composition of 30 coils, measured by EPMA, was CaO 50 wt %, $Al_2O_3$ 48 wt %, and $TiO_2$ 2 wt %.

The oxygen activity of the molten steel at the casting temperature was [aO]=0.00076, the optical basicity of the oxide inclusions was Λ=0.6667, and the S concentration in steel was [wt % S]=0.010 wt %. The equilibrium S soluble amount (% S inc.) of the oxides, in accordance with the aforementioned equation (1), was 0.106 wt %.

The coils were subjected to an indoor exposure test to determine the amount of rust formation (testing period: two weeks; average temperature: 20° C.; average humidity: 65%). When the number of rust points formed was counted, it was found that there were 252 rust points/100 $cm^2$, indicating that the rust points were substantially more numerous than those of an Al-deoxidized steel not containing Ca, and also more numerous than those of Example 1.

In this way, with the benefit of the present invention, it is possible to effectively inhibit the rust formation which would otherwise be caused due to the oxide inclusions, thereby solving a problem which has long been of concern in Ca-containing steels.

What is claimed is:

1. A Ca-containing rust-resistant steel comprising Ca at a concentration of 0.0005 wt % or more, wherein the composition of oxide inclusions and sulfur concentration in said steel are controlled so that the equilibrium sulfur soluble amount (% S inc.) value of at least 80% of CaO-containing oxide inclusions having a particle diameter of 2 μm or larger contained in said Ca-containing steel is about 0.03 wt % or less.

2. A Ca-containing rust-resistant steel comprising Ca at a concentration of 0.0005 wt % or more, wherein the composition of oxide inclusions and sulfur concentration in said steel are controlled so that the equilibrium sulfur soluble amount (% S inc.) value of at least 80% of CaO-containing oxide inclusions having a particle diameter of 2 μm or larger is about 0.03 wt % or less, wherein said equilibrium sulfur soluble amount (% S inc.) value is determined in accordance with the following equation (1), including as its parameters the optical basicity calculated from the composition of said oxide inclusions, the casting temperature and the components forming the steel, such equation being $$\log(\%\ S\ inc.)=(21920-54640\Lambda)/T+43.6\Lambda-23.9-\log[aO]+\log[wt\ \%\ S], \quad (1)$$

wherein

T represents the casting temperature (K) during the continuous casting process,

[wt % S] represents the concentration of S contained in said steel,

[aO] represents the oxygen activity of said molten steel at said casting temperature (T) during a continuous casting process, and wherein during Al-deoxidation, $$\log aO=(-64000/T+20.57-2\log[wt\ \%\ Al]-0.086[wt\ \%\ Al]-0.102[wt\ \%\ Si])/3, \text{ and}$$

wherein during Ti-deoxidation, $$\log aO=(-60709/T+20.97-2\log[wt\ \%\ Ti]-0.084[wt\ \%\ Ti])/3,$$

and provided that, when Al and Ti are present in said steel, a smaller aO oxygen activity is provided, wherein Λ represents the optical basicity of oxide inclusions according to equation (2)

$$\Lambda=1.0X(CaO)+0.605X(Al2O3)+0.601X(TiO2)+0.78X(MgO)+0.48X(SiO2)+0.55X(Cr2O3)+0.59X(MnO) \quad (2)$$

and wherein

X(MmOn) represents the cation equivalent of the oxide present, according to the following equation (3):

$$X(MmOn)=n\times N(MmOn)/\Sigma(n\times N(MmOn)), \quad (3)$$

wherein

N(MmOn) represents the mol fraction of oxide present and n represents the valence of oxygen contained in said oxide.

3. The Ca-containing rust-resistant steel according to claim 1, wherein the amount of Ca is 0.0015 to 0.0040 wt %.

4. The Ca-containing rust-resistant steel according to claim 1, wherein the amount of S is 0.010 to 0.020 wt %.

5. The Ca-containing rust-resistant steel according to claim 2, wherein the amount of Ca is 0.0015 to 0.0040 wt %.

6. The Ca-containing rust-resistant steel according to claim 2, wherein the amount of S is 0.0010 to 0.020 wt %.

* * * * *

UNITED STATES PATENT AND TRADEMARK OFFICE

CERTIFICATE OF CORRECTION

PATENT NO. : 6,841,123 B1
DATED : January 11, 2005
INVENTOR(S) : Nabeshima et al.

It is certified that error appears in the above-identified patent and that said Letters Patent is hereby corrected as shown below:

Column 5,
Line 51, please change “0.066” to -- 0.086 --.

Signed and Sealed this

Twenty-second Day of November, 2005

JON W. DUDAS
*Director of the United States Patent and Trademark Office*